US006332492B1

(12) United States Patent
Donini et al.

(10) Patent No.: US 6,332,492 B1
(45) Date of Patent: Dec. 25, 2001

(54) METHOD TO CONTROL THE AXIAL POSITION OF SLABS EMERGING FROM CONTINUOUS CASTING AND RELATIVE DEVICE

(75) Inventors: Estore Donini, Vimercate; Fausto Drigani, Zugliano; Cesare Galletti, Segrate S. Felice; Roberto Millone, Genoa, all of (IT)

(73) Assignee: Danieli & Officine Meccaniche SpA, Buttrio (IT)

( * ) Notice: Subject to any disclaimer, the term of this patent is extended or adjusted under 35 U.S.C. 154(b) by 0 days.

(21) Appl. No.: 09/554,163

(22) PCT Filed: Nov. 9, 1998

(86) PCT No.: PCT/IB98/01791

§ 371 Date: Jun. 20, 2000

§ 102(e) Date: Jun. 20, 2000

(87) PCT Pub. No.: WO99/24186

PCT Pub. Date: May 10, 2000

(30) Foreign Application Priority Data

Nov. 11, 1997 (IT) ..... UD97A0210

(51) Int. Cl.[7] ..... B22D 11/00; B22D 11/12; B22D 11/20; B22D 11/128

(52) U.S. Cl. ..... 164/476; 164/448; 164/454; 164/484

(58) Field of Search ..... 164/442, 484, 164/447, 448, 476, 454

(56) References Cited

U.S. PATENT DOCUMENTS

| | | | | |
|---|---|---|---|---|
| 4,338,077 | * | 7/1982 | Shibayama et al. | 432/11 |
| 4,420,145 | * | 12/1983 | Martini | 266/90 |
| 4,918,803 | * | 4/1990 | DiGiusto | 29/33 |
| 5,156,800 | * | 10/1992 | Buchet et al. | 266/99 |
| 5,267,604 | * | 12/1993 | Kutnner et al. | 164/413 |
| 5,490,315 | * | 2/1996 | Kostopolos et al. | 29/527.7 |

* cited by examiner

*Primary Examiner*—M. Alexandra Elze
*Assistant Examiner*—Len Tran
(74) *Attorney, Agent, or Firm*—Antonelli, Terry, Stout & Kraus, LLP

(57) ABSTRACT

Method and device to control the axial position of slabs emerging from a continuous casting machine, providing to control the axial position of the slab (24) in correspondence with the inlet to the first rolling stand and to act in feedback on means to modify the correct position of the axis (32) of the slab (24) in a position located between the first rolling stand and the foot rolls (26) of the ingot mold (13) from which the slab (24) emerges, wherein alignment means operating inside the furnace (15) are employed to induce a controlled lateral displacement governed by the control of the axial position of the slab (24).

31 Claims, 7 Drawing Sheets

METHOD TO CONTROL THE AXIAL POSITION OF SLABS EMERGING FROM CONTINUOUS CASTING AND RELATIVE DEVICE

FIELD OF THE INVENTION

This invention concerns a method to control the axial position of slabs emerging from continuous casting and the relative device as set forth in the respective main claims.

The invention is applied in rolling mills which have the rolling train located in line with the continuous casting machine, and is employed to obviate the problems of the slab emerging from the casting machine with its axis misaligned with respect to the axis of the first rolling stands.

The invention is employed both when the slab is less than 100–120 mm thick and is sheared to size in segments, and also when the slab is obtained with a whole cast of molten metal, and also when the slab is worked with continuity between the casting machine and the rolling train.

BACKGROUND OF THE INVENTION

One of the main problems which rolling mill operators complain about is how to control the axial position of the slab with respect to the axis of the first rolling stands located downstream of the heating furnace.

It is well-known that the slab as it emerges from the continuous casting machine, since it must be subjected to the processes of extraction, pre-rolling and straightening, rarely remains correctly aligned with the axis of feed; this causes considerable problems when the slab enters the rolling stands and during the rolling steps.

Moreover, as it travels inside the tunnel furnaces, either the heating furnace or the temperature maintenance furnace, the slab may be subject to lateral displacements which send it out of line.

If the slab arrives misaligned with respect to the axis of the first stand, rolling becomes difficult, particularly when thin diameters are being rolled.

In fact, in order to compensate for this misalignment after the slab has entered the stand, and to ensure that it enters the downstream stand correctly, it is necessary to act on the horizontal positioning of the first stand, which may have negative effects on the symmetry of the profile in the cross section of the slab itself.

While this does not create particular problems when the partly rolled product has a greater thickness, for example above 2 mm, in the case of thinner products there are considerable problems of quality, inasmuch as it becomes extremely difficult, if not impossible, to recover the difference in thickness between one side and the other, when the product is 0.6–0.8 mm thick.

In the case of thin products the transverse sliding of the material is very difficult to obtain and in any case it causes errors in planarity deriving from a differentiated stretching of the material.

In order to solve these problems, at least partly, solutions known to the art employ the action, either individually or in combination, of lateral guides, of the descaling assembly or the rolls or assemblies to finish the edges, which are arranged between the outlet of the heating furnace and the inlet to the stand, in order to obtain the progressive axial alignment of the slab and the rolling axis.

These solutions have shown themselves to be only partly efficacious, for a variety of reasons.

First of all, there is a technological requirement whereby the entrance to the stand cannot be too distant from the outlet of the furnace (the typical maximum value is around 14–20 meters), to prevent the excessive cooling of the slab to below the optimum rolling temperature.

For this reason it is necessary to obtain a great displacement of the slab per unit of length of the plant, in order to obtain the desired alignment in correspondence with the inlet to the stand.

Guide systems as are known to the art, however, are not able to obtain such values of displacement, and therefore they do not enable the desired alignment to be reached in the little space available between the furnace and the stands, which is imposed by technological constraints.

Lateral guides as are known to the art, moreover, occupy about 10 meters in length of the segment between the furnace and the stand, and define a transit width which is greater than the width of the slab, on both sides, by at least 25 mm per side, up to as much as 50 mm per side. Therefore, the alignment of the slab is imprecise by values of ±25–50 mm.

Moreover, the rollers which refine the edges, or edgers, cannot act upon the edges of the slab for more than about 10 mm per side.

All these factors make it impossible to centre the slab if the slab arrives misaligned with respect to the rolling axis beyond a minimum value which can be compensated, and which can be estimated in the region of ±10 mm.

There is also the further problem concerning the transport rollers inside the heating furnace.

In order to withstand the extremely high temperatures of up to 1110–1200° C. inside the furnace, these rollers are structured with cooled rolls which support disks made of refractory material which is mechanically very delicate, so that even a slight transverse displacement of the advancing slab causes considerable damage and puts the disks out of action very quickly.

It is therefore highly inadvisable to make the slab translate laterally when it is inside the furnace.

JP-A-62235429 teaches to provide nozzles arranged above and below the rolled stock passing through, which deliver a jet of gas in the opposite direction to the direction of feed of the rolled stock.

The nozzles are arranged in a zig-zag conformation and exert an action of mechanical displacement on the rolled stock if it is not centered with respect to the relative feeding means.

This device makes possible to obtain only limited adjustments in the position of the rolled stock, and moreover it may cause unacceptable modifications in the surface temperature conditions thereof.

EP-A-416356 describes an alignment station for rolled products arranged between the drawing-straightening assembly which acts on the rolled stock emerging from the continuous caster and the shears which shear the rolled stock into segments which are then sent to the temperature equalisation furnace.

The alignment station consists of a supporting roller, positioned under the plane on which the rolled stock is fed, with bearings which are connected to a relative vertical piston suitable to incline the roller to one side or the other so as to correct any possible lateral displacement of the rolled stock.

Alternatively, the alignment station comprises at least a burner, or at least a sprayer nozzle, cooperating with at least one edge of the rolled stock in order to align the rolled stock, either by exploiting the dilation caused by heating, or by exploiting the shrinkage caused by cooling.

The fact that the alignment station is positioned upstream of the shears assembly and of the furnace creates the problem that, precisely during the shearing cycle or during the heat treatment in the furnace, the segment of rolled stock becomes misaligned and arrives in correspondence with the first stands of the rolling train in an out-of-center condition.

Moreover, the inclusion of a single alignment roller can make it impossible to correct misalignments of the rolled stock of a certain entity, inasmuch as the lowering or raising of one side of the roller with respect to the other is limited by the overall height of the plane of feed.

Furthermore, EP'356 does not mention any systems to control the position of the slab with respect to the axis of the rolling stands, nor any feedback systems which govern the alignment means and condition the functioning thereof in the event of misalignments being found downstream.

The present applicant has designed and tested this invention to overcome these shortcomings which cause serious operating and technological problems, and problems of quality, in the rolling of flat products, particularly thin flat products of less than 2 mm and down to 0.8–0.5 mm.

SUMMARY OF THE INVENTION

The invention is set forth and characterised in the respective main claims, while the dependent claims describe other characteristics of the main embodiment.

The purpose of the invention is to centre and axially align the slab as it emerges from the continuous casting machine so that, when it arrives at the entrance to the first stands, whether they be roughing stands, pre-finishing or finishing stands, it is perfectly aligned with the axis of these stands.

The invention obtains the aforesaid result without causing any deterioration on the surface or edges of the slab, without any risk of damaging the disks of the transport rollers inside the furnace, without any substantial modifications to the structure of the lateral guides, the edgers or the descaling assembly located at the outlet of the furnace, nor of the channels used to guide the rolled stock which are located at the entrance to the stands.

The invention allows to reduce the extension of the lateral guides, or even to eliminate them, with consequent advantages in terms of lay-out; thus the slabs are hotter as they enter the rolling stands and the length of the plant is reduced.

The invention uses the individual or combined action of a plurality of assemblies and devices located between the outlet of the ingot mold, in the zone of the foot rolls which contain and extract the slab, and the inlet of the first rolling stand.

According to the invention, the slab emerging from the ingot mold is subjected to a controlled cooling process cooperating with the sides of the slab, in order to obtain a desired lateral displacement achieved by the different thermal expansion of the two sides of the slab.

In other words, if it is discovered that the slab leaves the continuous casting machine already misaligned with respect to the nominal rolling axis, the secondary cooling assemblies are made to act in a controlled manner so as to achieve a differentiated thermal expansion on the two sides to compensate, at least partly, the extent of this misalignment.

According to a variant, downstream of the secondary cooling assemblies and/or in an intermediate position between them there are elements to measure and control the axial position.

The measurement and control elements verify, either continuously or periodically, that the misalignment is corrected and condition the secondary cooling assemblies in feedback in order to vary the intensity and action of the cooling in a desired manner.

According to another variant, in the event that the measurement and control elements verify that there is an excessive displacement which can no longer be compensated downstream, they order shearing means to be activated which intervene and form short slabs which can easily be manipulated inside the furnace even if they are progressively misaligned.

According to the invention, the rollers inside the heating furnace are driven independently, individually or in groups, in such a way as to determine the progressive re-alignment of the advancing slab.

In one embodiment, the rollers are arranged at an angle with respect to the nominal horizontal plane on which the slab lies, and the even rollers and the odd rollers are driven in an autonomous and separate manner.

The motors of the odd and even rollers are governed, according to a variant, by means to control the axial position of the slab, which order the rollers to be activated according to the extent of the misalignment found, possibly correcting the working parameters in feedback.

The different and controlled speed of rotation of the odd and even rollers inside the furnace, together with their angled position with respect to the plane of the slab, causes a progressive re-alignment of the slab with respect to the rolling axis of the stand located downstream, without causing any deterioration of the slab itself, and without intervening on the guide devices located between the furnace and the stand.

In another embodiment of the invention, the rollers of the furnace, either individually or in groups, are associated with means which regulate the inclination of the rollers on the horizontal plane with respect to the nominal position which corresponds to the orthogonal to the axis of feed of the rolled stock.

The said inclination regulation means are governed by means which control the axial position of the slab at the outlet of the furnace, and intervene by varying the inclination of the rollers, on one side and/or the other thereof and by defined angles, until the axial position of the rolled stock has been restored with respect to the axis of the first rolling stands.

In a further embodiment of the invention, there is a trolley used as an element to transport the slab, with an insulated cover and with heating means, which functions at least partly as a heating and/or temperature maintenance furnace.

The trolley can be translated sideways in a controlled manner.

In this embodiment, there is a device to control and measure the axial position of the slab, located at the outlet of the trolley, which verifies the alignment with respect to the axis of the first stand, and commands the lateral displacement of the trolley in such a manner as to take the slab progressively into alignment with the rolling axis. These verifications and consequent lateral displacements may take place either continuously or periodically at pre-determined intervals.

According to a variant, the device to control and measure the axial position is included, or also included, inside the trolley.

According to another variant, the two supporting girders lengthwise to the furnace, on which the rollers which extend inside the furnace are mounted, are sub-divided into several coherent segments which are equipped with lateral movement independent from each other.

These independent lateral movements, commanded by means to control and measure the axial position of the slab, make it possible to correct any possible misalignment of the slab and reduce its misalignment with respect to the nominal rolling axis. This embodiment is particularly indicated for long slabs, up to 200–300 meters long, that is, slabs which occupy substantially the whole length of the tunnel furnace.

According to a further variant, the rollers of the furnace are associated, on the opposite side with respect to the side of the motor, with a support which can be raised and lowered to modify the lateral position of the slab travelling through the said furnace.

The rollers, according to a further variant, are in groups and are raised/lowered in a coordinated and progressive manner by means of actuators associated with the monitoring of any misalignment between the axis of the slab and the rolling axis.

According to another embodiment, the respective disks of the rollers are arranged alternately between one roller and the subsequent roller, that is to say, the disks are grouped together on one half of one roller and on the other half of the following roller.

This configuration gives an undulated progress of the slab inside the furnace, which regularises the position and substantially aligns the slab with the rolling axis.

According to another embodiment, outside the furnace in a lateral position thereto, there are cone-shaped rollers distributed along the length of the furnace and on both sides thereof, to a desired number at intermediate positions between the usual transport rollers.

One and/or the other of the conical rollers are inserted inside the furnace when a misalignment of the slab is monitored, so that a controlled axial displacement is determined due to the conical shape of the rollers.

When the conical rollers are inserted the slab is lifted and loses contact with the usual transport rollers and can therefore be laterally displaced in the desired direction.

According to a variant, two conical rollers arranged coaxial on one side of the furnace and the other are inserted simultaneously inside the furnace so as to completely lift the slab and translate it sideways in the desired direction.

According to another variant, the conical rollers have a raised edge on the base which is used as an element to physically displace the slab.

According to a further variant, the conical rollers with the raised edge are maintained constantly inside the furnace on the two sides thereof so as to function as an element to constantly control the axial position of the slab and to limit the lateral displacement.

BRIEF DESCRIPTION OF THE DRAWINGS

The attached Figures are given as a non-restrictive example and show some preferential embodiments of the invention as follows.

DETAILED DESCRIPTION OF THE PREFERRED EMBODIMENT

Figure 1:
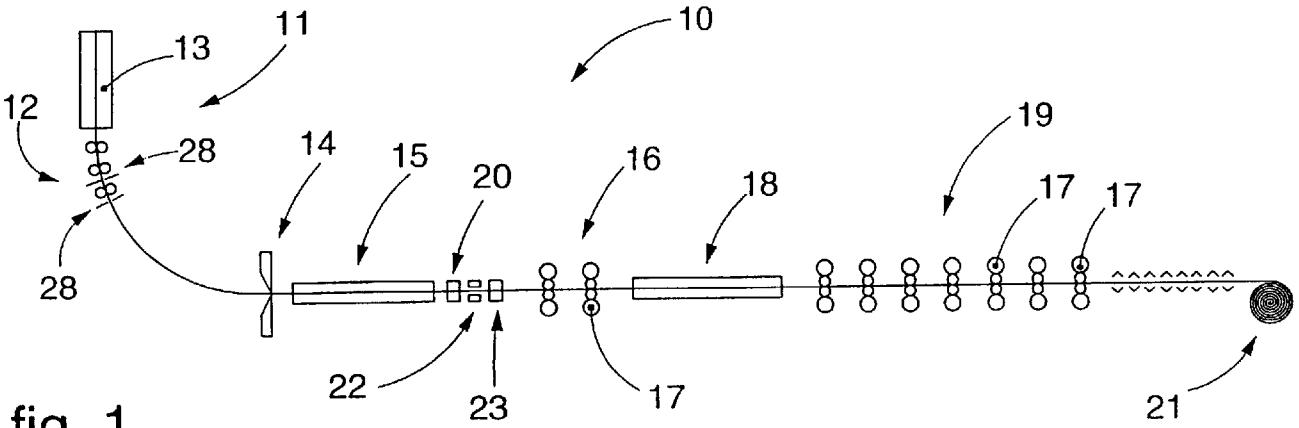
FIG. 1 is a diagram of a rolling line, seen from the side, directly connected to the continuous casting machine to which the invention is applied.
Figure 2:
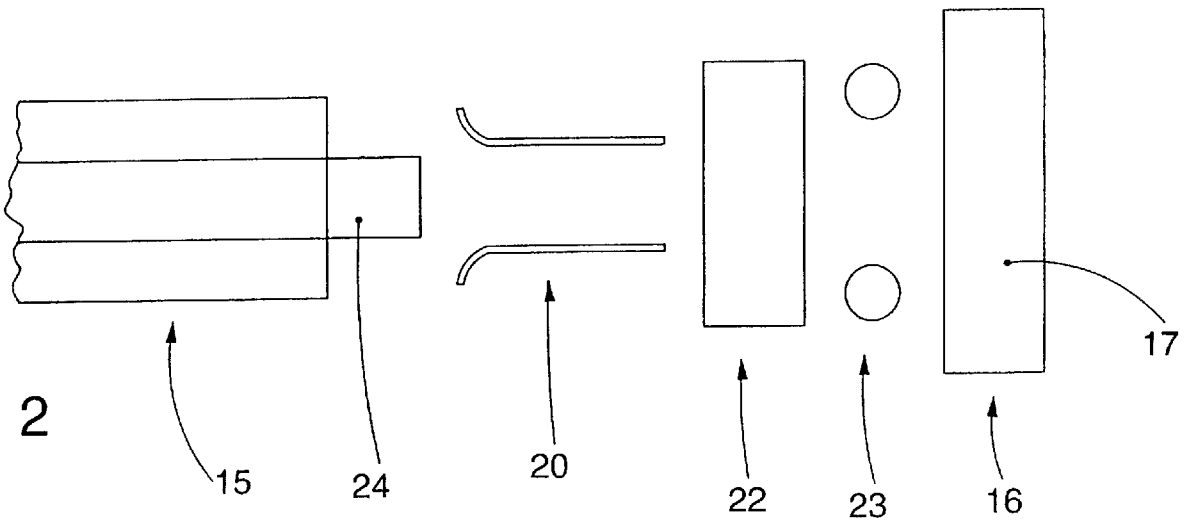
FIG. 2 is a diagram of a segment of the line shown in FIG. 1, as seen from above.

The rolling line 10 shown diagrammatically in FIG. 1 comprises a rolling train 19 arranged in line with a continuous casting machine 11 including an ingot mold 13 and an extraction and straightening assembly including rollers 12.

Downstream of the assembly 12 there is a shears for shearing to size 14 and a heating and/or temperature maintenance furnace 15 which feeds the slabs at temperature to a rolling train 16, in this case with two stands 17, which can be a roughing train or a pre-finishing train according to the case.

Between the train 16 and the finishing train 19, in this case, there is a system to equalise and restore the temperature 18, while downstream of the finishing train 19 there is the coiling assembly 21 to coil the strip produced.

In this case, between the heating furnace 15 and the train 16 there are conventional systems including lateral guides 20, a descaling assembly 22 and an assembly to finish the edges 23, of the type including rollers.

According to the invention, the rolling line 10 includes means to align the axial position of the slab 24 as it emerges from the continuous casting machine 11 to the rolling axis 25 of the rolling stands 17 and particularly to the axis 25 of the first stand 17 of the train 16.

Figure 3:
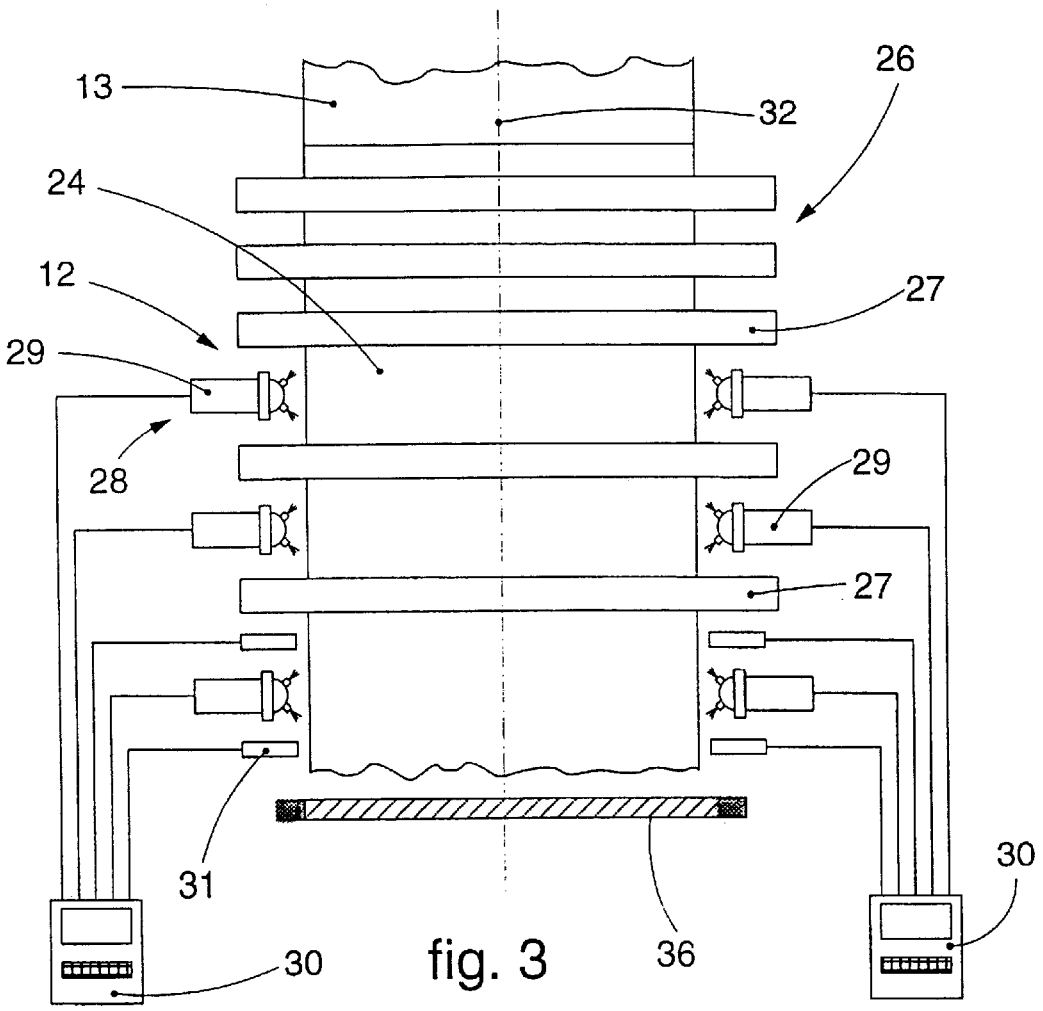
FIG. 3 shows a first embodiment of the invention applied at the outlet of the continuous casting machine.

FIG. 3 shows a first embodiment of the invention. In this case, the slab 24 emerging from the ingot mold 13 and from the foot rolls 26, and engaged by the rollers 27 of the extraction and straightening assembly 12, is made to cooperate with cooling means 28 comprising delivery nozzles 29 cooperating with the sides of the slab 24.

The delivery of the cooling fluid by the delivery nozzles 29 is governed by command units 30 which receive position signals from detectors 31 arranged in cooperation with the sides of the slab 24 being extracted.

The detectors 31 are pre-set to detect the position of the axis 32 of the slab 24 and to verify any difference in the axial position with respect to the rolling axis 25.

There may also be a detector 36 suitable to detect the position of the edges, which does not need re-positioning as the width of the slab 24 varies.

When a misalignment is detected, there is a variation in the delivery of the cooling fluid, possibly differentiated on the two sides of the slab, by means of a controlled activation of the nozzles 29.

By means of this control, which is carried out directly during the step of secondary cooling, the axis 32 of the slab 24 can be aligned with the rolling axis by laterally displacing the slab 24 itself due to thermal expansion.

In the event that the displacement is excessive, and cannot be compensated downstream, the invention provides to activate the shears 14 as an emergency shears, in order to obtain short slabs of such a size that the front edges do not damage the inner refractory surfaces of the furnace 15, even if the slab is misaligned.

Figure 4:
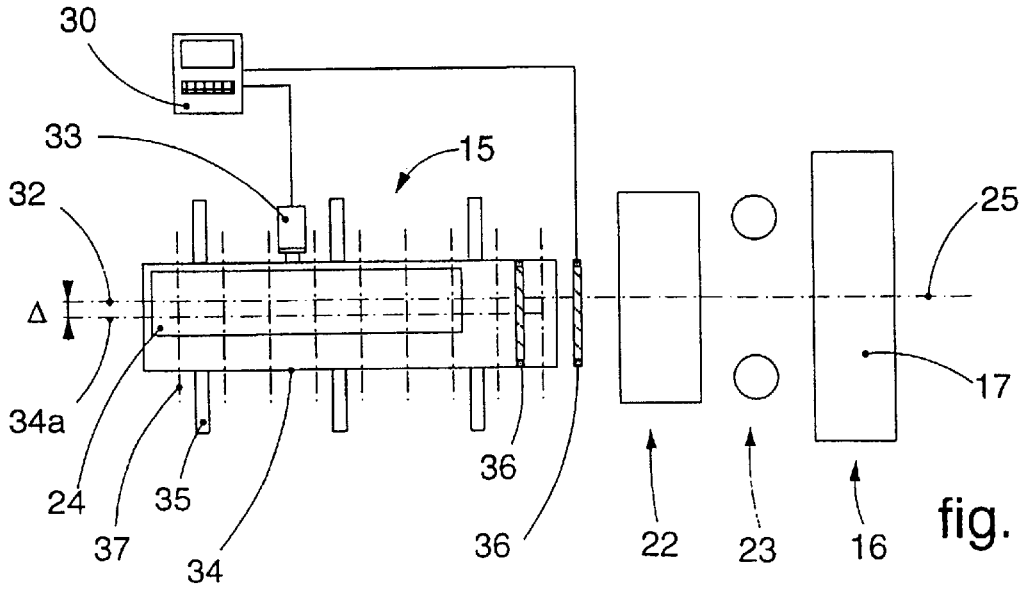
FIG. 4 shows another embodiment of the invention as applied to the heating furnace located upstream of the first rolling stand.

In the embodiment shown in FIG. 4, the heating and temperature maintenance furnace 15 consists of a trolley 34, which can be moved sideways on rails 35, inside which the supporting rollers identified by the axes 37 are mounted.

The trolley 34 cooperates with an insulated hood 38 associated with heating means and intake means which are not shown here.

The trolley 34 can receive slabs 24 from one or more casting lines and can be employed to feed a single rolling train with slabs 24 arriving from several casting lines or from stores of cold slabs or of special products.

According to the invention, the lateral movement of the trolley 34 is used to axially align slabs 24 which are misaligned with respect to the rolling axis 25.

To be more exact, the axial position of the slabs 24 is monitored by detector means 36 arranged stationary at the outlet of the furnace 15 and upstream of the train 16, or inside the trolley 34 itself, which are connected in feedback with a control unit 30.

The control unit 30, according to the position signals arriving from the detector means 36, activates the actuator 33 which laterally displaces the trolley 34, progressively aligning the axis 32 of the slab 24 to the rolling axis 25.

In the case shown here, the trolley 34, with an axis 34*a*, has been displaced by a value $\Delta$ so as to align the rolling axis 25 to the axis 32 of the slab 24, the slab 24 having entered the trolley 24 misaligned with respect to the axis 25.

Once the slab 24 has emerged, the trolley 34 can be progressively taken back to its original position, that is to say, with its axis 34*a* aligned with the rolling axis 25.

Figure 5A:
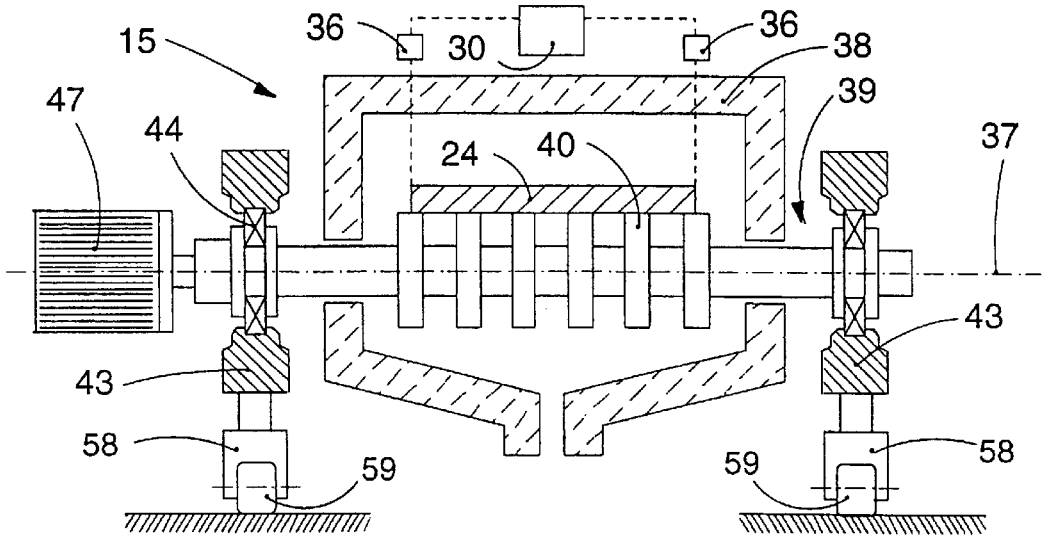
FIGS. 5*a* and 5*b* show, respectively from the front and from above, another embodiment of the invention.
Figure 5B:
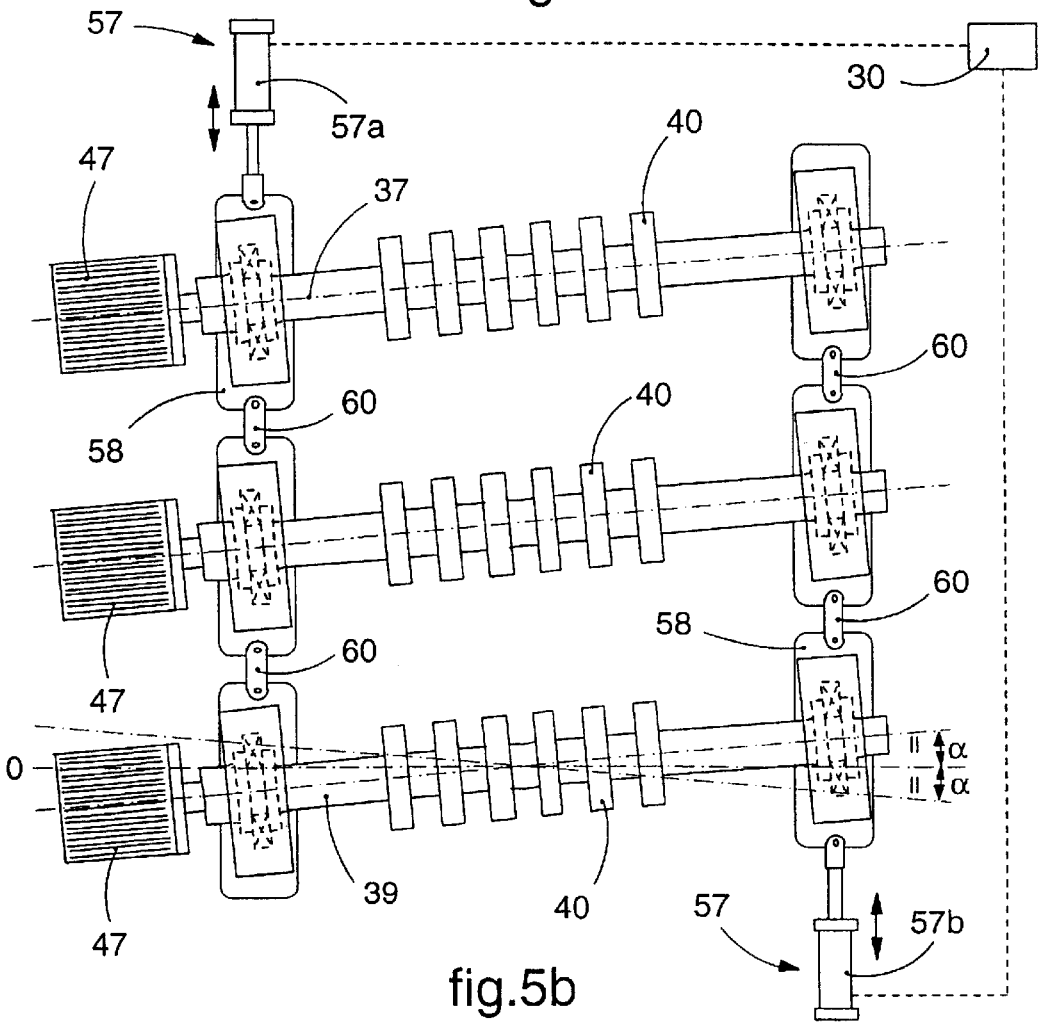

In the embodiment shown in FIGS. 5*a* and 5*b*, the supporting rollers 39 inside the furnace 15 are associated, individually or in groups, with piston means 57, respectively 57*a* on one side and 57*b* on the opposite side, suitable to displace the inclination of the rollers 39 with respect to the horizontal plane on which the said rollers 39 lie.

To be more exact, the supporting rollers 39, which have a nominal position "0" wherein their axis 37 is substantially orthogonal to the axis of feed of the slab 24, are inclined on the horizontal plane by an angle $\alpha$, in one direction or the other, by activating the piston 57*a* or 57*b*.

The entity of the inclination $\alpha$ and the direction of the inclination are determined according to the signals supplied by the detector means 36, which measure the entity of the misalignment of the slab 24 at the outlet of the furnace 15, and send the signals to the control unit 30.

The control unit 30 processes the data and sends command signals to the piston means 57*a* and 57*b* to restore the correct alignment of the slab 24 with respect to the axis of the first rolling stands.

The rollers 39 are assembled individually on trolleys 58 equipped with wheels 59 and each can be equipped with its own piston means 57.

In the embodiment shown in FIG. 5*b*, several rollers 39 are connected together by means of respective connection means 60, which allows the rollers 39 to be driven simultaneously; this can affect groups of rollers 39 or even the whole totality of rollers 39 inside the furnace 15.

Figure 6:
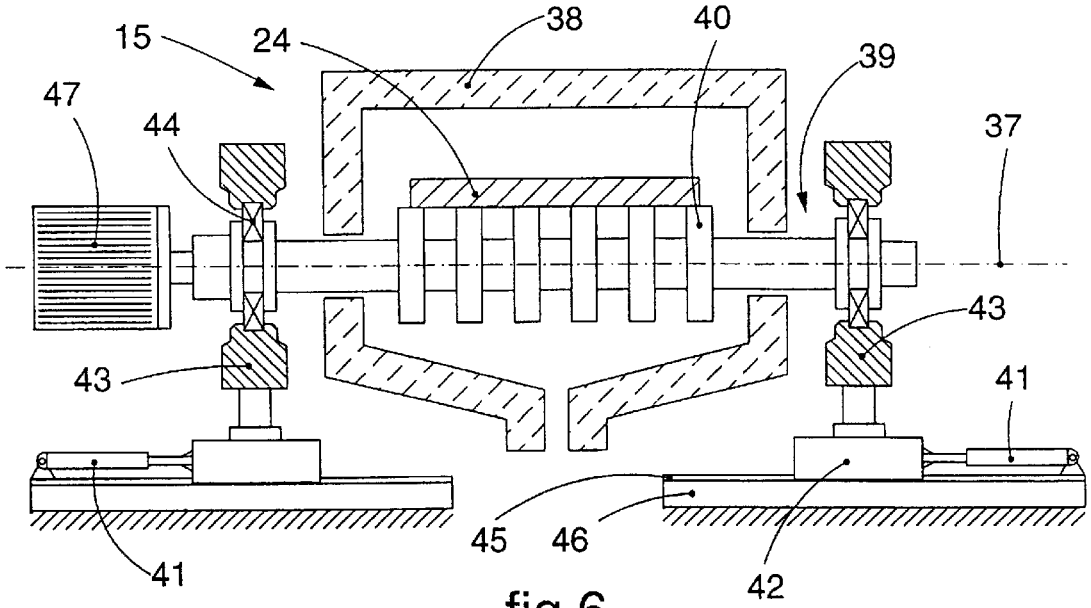
FIGS. 6 and 7*a* show further embodiments of the invention.

In the further embodiment as shown in FIG. 6, the supporting rollers 39 inside the furnace 15 can be displaced laterally in a controlled manner, parallel to their axis 37, with respect to the stationary structure 38 of the furnace 15, which does not move.

In a first embodiment, all the rollers 39 can be laterally displaced independently of each other.

According to a variant, the rollers 39 can be displaced in groups, for example two by two or three by three.

The lateral displacement can be commanded by position detectors of the same type as the detectors 36 as shown in FIG. 4; it allows to displace the slab 24 laterally as it rests on the disks 40 without the slab 24 sliding laterally on the disks 40, that is to say, without damaging them and wearing them out.

The position detectors 36, which are not shown in FIG. 5, are connected in feedback with the displacement actuators 41 which act on the sliders 42 on which the bench supports 43 rest; the bench supports 43 support the rotation bearings 44 of the rollers 39.

The rollers 39 are made to rotate by a motor 47. The sliders 42 slide on guides 45 made on displacement planes 46.

Once the trailing end of the slab 24 has left each individual roller 39 or group of rollers 39, the rollers are re-aligned to receive a new slab 24.

Figure 7A:
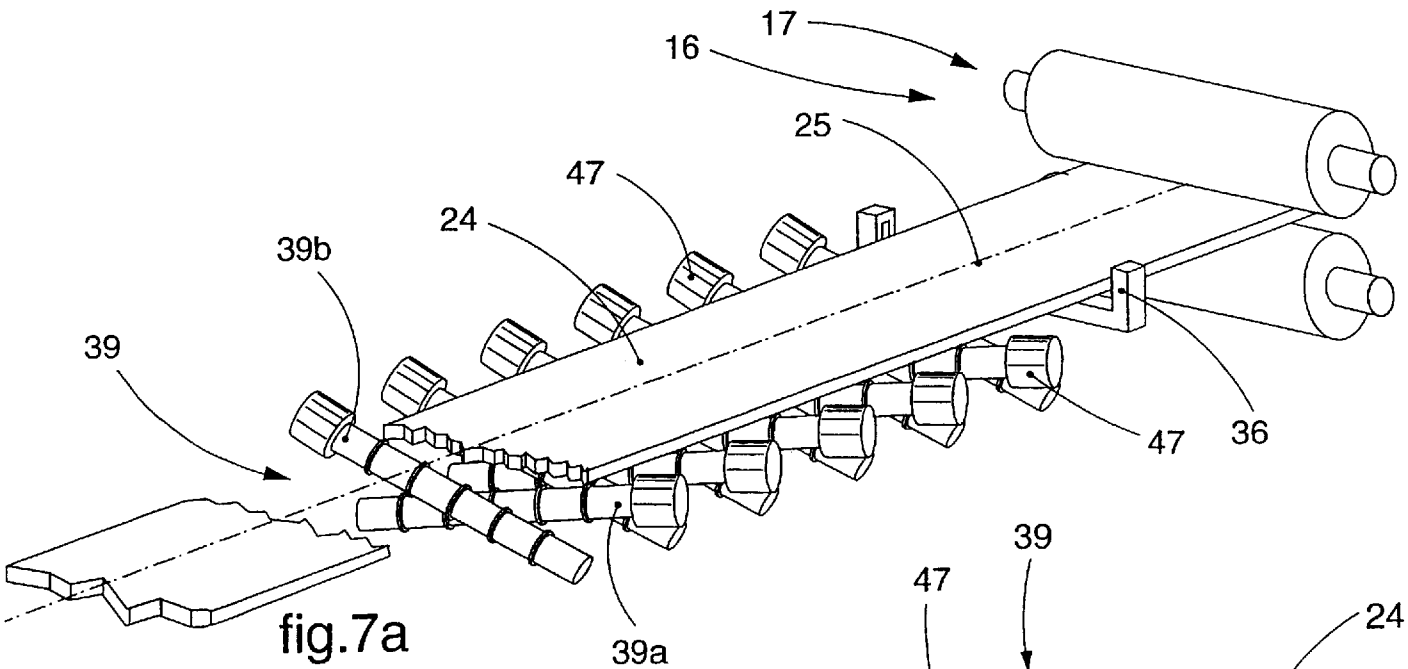

In the embodiment shown in FIG. 7*a*, the axial alignment of the slab 24 with respect to the rolling axis 25 is obtained by modulating the speed of rotation of the rollers 39 in a differentiated manner.

In this specific case, the rollers 39 are angled with respect to the plane on which the slab 24 lies.

The odd rollers 39*a* are commanded by one command unit while the even rollers 39*b* are commanded by their own autonomous command unit.

The command units are connected in feedback with detectors 36 of the type shown in FIG. 4, suitable to detect any axial misalignment between the axis of the slab 32 and the rolling axis 25.

If any misalignment is detected, and according to the extent of the misalignment, the rollers 39*a* and 39*b* are commanded to obtain the controlled lateral displacement of the slab 24 by acting on their differentiated and variable speeds.

Figure 7B:
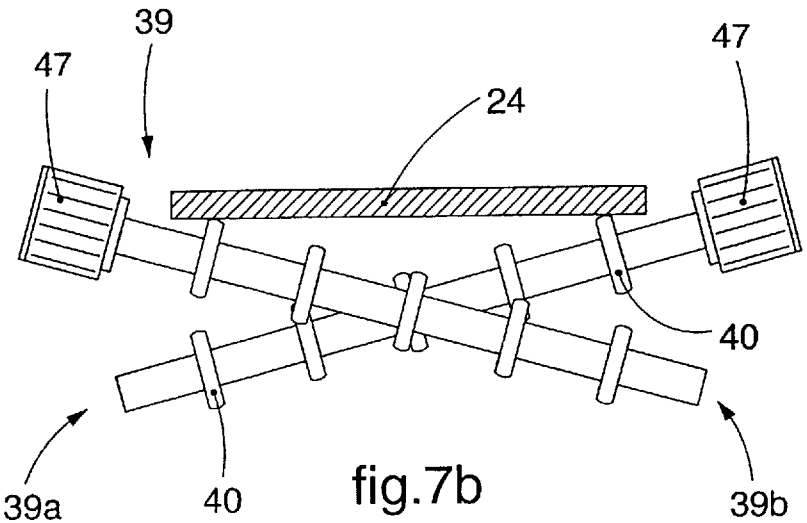
FIG. 7*b* shows a part front view of FIG. 7*a;*

By inclining the rollers 39 with respect to the plane of the slab 24, the contact points of the relative disks 40 rotate at different speeds on one side of the slab 24 and the other (FIG. 7*b*) and therefore the slab 24 can be displaced laterally in a controlled manner.

According to a variant, each roller 39 can be controlled individually and independently of the other rollers 39.

Figure 8:
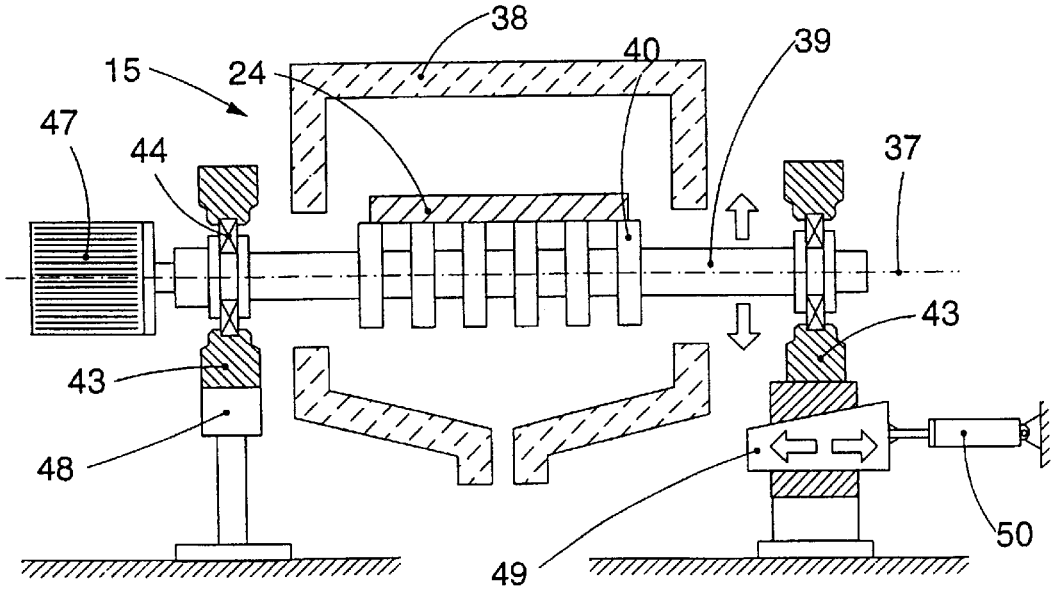
FIG. 8 shows a cross section of another embodiment of the invention.

In the embodiment shown in FIG. 8, the rollers 39 are supported at the side, on the side of the motor, by a stationary support 48, while on the opposite side they are supported by a support 49 which is vertically movable.

In the embodiment shown here, the support 49 consists of a plane inclined towards the furnace 15 and cooperating with an actuator 50 which displaces the support 49 on the horizontal plane.

When the actuator 50 is activated in one direction or the other, there is a correlated lifting or lowering of the movable support 49, and therefore one side of the relative roller 39 is consequently inclined in one direction or the other.

Figure 9A:
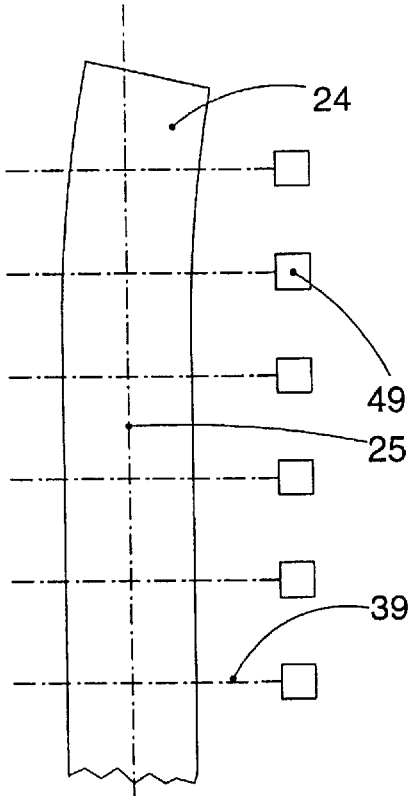
FIGS. 9*a* and 9*b* show two working arrangements of the embodiment shown in FIG. 8.
Figure 9B:
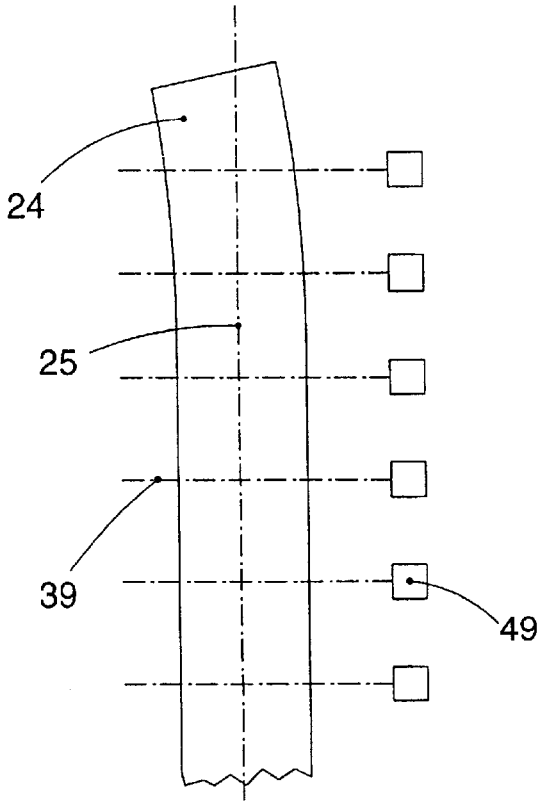

FIGS. 9*a* and 9*b* show two possible conditions which may occur:

in FIG. 9*a,* where the slab 24 tends to become misaligned towards the right with respect to the rolling axis 25, the movable supports 49 are raised so as to incline the rollers 39 downwards and towards the left;

in FIG. 9*b,* where the slab 24 tends to become misaligned towards the left with respect to the rolling axis 25, the movable supports 49 are lowered so as to incline the rollers 39 downwards and towards the right.

The actuator 50 is connected, advantageously by means of a control system in feedback, to a command unit which receives signals relative to the misalignment of the slab 24 from detectors 36 arranged inside the furnace 15 and correlates the extent and the direction of movement of the movable supports 49 to the extent of the misalignment.

Figure 10:
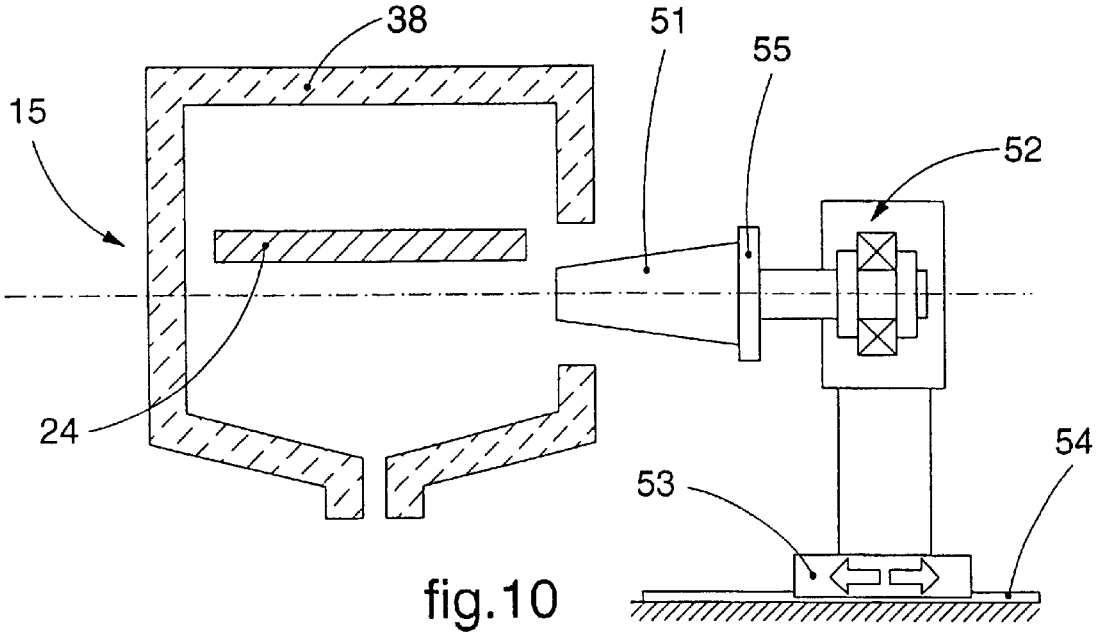
FIG. 10 shows a further embodiment of the invention.
Figure 11:
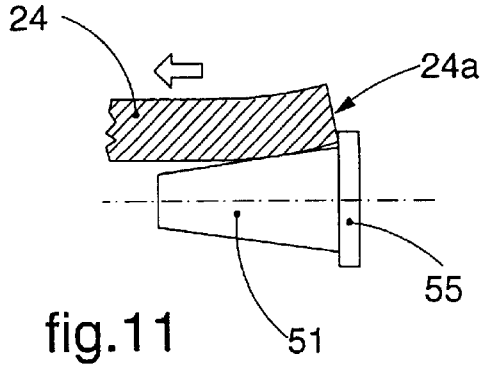
FIG. 11 shows a working arrangement of the embodiment shown in FIG. 10.

In the embodiment shown in FIG. 10, in a lateral position outside the furnace 15, advantageously on both sides of the furnace 15, there are conical rollers 51, cooled and mounted as cantilevers on a relative support 52; their axis is parallel to the axis 37 of the usual feeder rollers 39.

The support 52 is associated with a slider 53, which slides on a guide 54, so as to take the roller 51 from a stand-by position outside the furnace 15 to an active position wherein it is inserted inside the furnace 15; as it enters into cooperation with the slab 24, it raises the slab 24 at least on one side from the usual feeder rollers 39 and causes it to be displaced sideways in the desired manner.

In the event that the lateral displacement caused only by the conical shape of the working surface of the roller 51 is not sufficient, or in any case difficult to achieve, a raised edge 55 cooperating with the base of the roller 51 is brought into contact with an edge 24*a* of the slab 24 so as to physically displace the slab 24.

The conical rollers 51 can be arranged alternate and off-set, on one side of the furnace 15 and the other, along the whole length of the furnace 15 itself, for example every 4–6 of the usual rollers 39.

Figure 12:
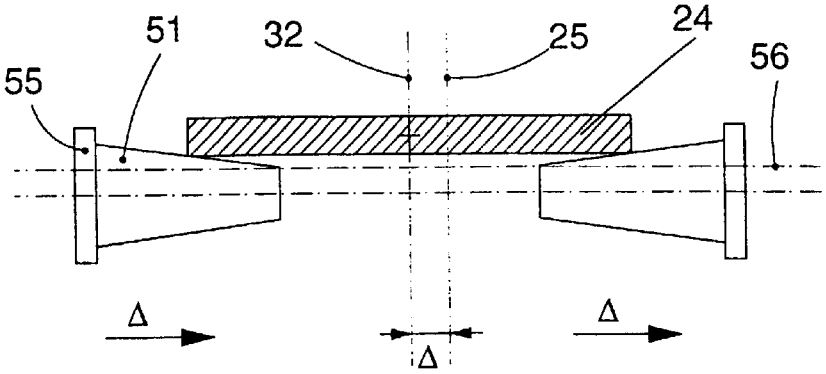
FIG. 12 shows a variant of FIG. 11.

According to the variant as shown in FIG. 12, the conical rollers 51 are in pairs, arranged axially on one side of the furnace 15 and the other, and are made to act simultaneously so as to raise the slab 24 from the supporting plane 56 defined by the usual rollers 39, and to displace it laterally, in one direction or the other according to the misalignment $\Delta$ detected between the rolling axis 25 and the axis 32 of the slab 24, by introducing the conical rollers 51 inside the furnace 15 to a greater or lesser extent.

Once the slab 24 has been repositioned axially, the conical rollers 51 are returned to their stand-by position outside the furnace 15.

Figure 13:
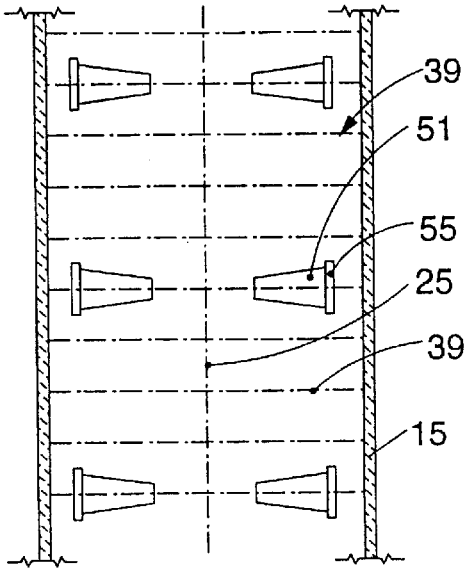
FIG. 13 shows a variant of the previous embodiments.

According to the variant as shown in FIG. 13, which is valid for every embodiment described hereinbefore, the conical rollers 51 are maintained constantly inside the furnace 15, arranged on both sides thereof, and function as elements to control and limit the maximum difference between the axial position of the slab 24 and the rolling axis 25.

The conical rollers 51, arranged coaxially in pairs at an intermediate position, for example every four usual rollers 39, with their raised edges 55 define the position of maximum lateral displacement of the slab 24; at the same time, with their inclined work planes, they act as elements to constantly and continuously control the axial position of the slab 24.

Figure 14:
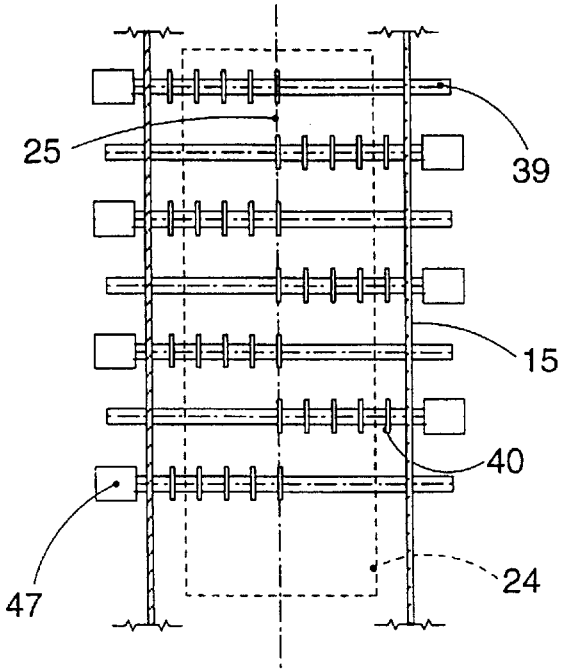
FIG. 14 shows a further embodiment of the invention.

According to the further variant as shown in FIG. 14, the disks 40 mounted on the rollers 39 are arranged in groups on one half of one roller 39 and on the other half of the roller 39 immediately after.

This arrangement of the disks 40, together with the individual control of the speed of rotation of the individual rollers 39, makes it possible to give an undulated development to the slab 24 as it passes through the furnace 15, to control the lateral position thereof and to correct any possible misalignment of the slab 24 with respect to the rolling axis 32.

What is claimed is:

1. Method to control the axial position of slabs emerging from the continuous casting machine applied in rolling lines comprising at least a continuous casting machine (11) with at least an ingot mold (13), an extraction and straightening assembly (12), shearing means (14), a heating and/or temperature maintenance furnace (15), a roughing or pre-finishing train (16) and a finishing train (19) defining a rolling axis (25), wherein said furnace (15) comprising a plurality of transport rollers (39) defining a substantially horizontal supporting and conveying plane for said slabs, there being included between the outlet of said heating and/or temperature maintenance furnace (15) and the inlet of said roughing train (16) lateral guides (20) and at least a descaling assembly (22), comprising the steps of: laterally aligining the axis (32) of said slab (24) emerging from said continuous casting machine (11) to the rolling axis (25) of a first stand of said roughing or pre-finishing train (16) or of a first stand of said finishing train (19), providing to continuously control the axial position of the slab (24) with respect to said rolling axis (25) by means of detector means (36) arranged at least upstream of the entrance of said first rolling stand and to act in feedback on alignment means operating inside said heating and/or temperature maintenance furnace (15) and cooperating with said transport rollers (39), wherein said aligment means being able to modify the position of said axis (32) by inducing a controlled lateral displacement of said slab (24) in transit on said supporting and conveying plane functionally correlated to said control of the axial position of the slab (24).

2. Method as in claim 1, characterised in that said alignment means operating inside said heating and temperature maintenance furnace (15) laterally displace the slab (24) by means of a controlled inclination on the horizontal plane of at least some of said transport rollers (39) located inside the furnace (15), the entity of the angle "$\alpha$" of inclination and the direction of the inclination being a function of the entity of misalignment of the slab (24) with respect to the rolling axis (25) as detected by said means (36).

3. Method as in claim 1, characterised in that said alignment means operating inside said heating and temperature maintenance furnace (15) laterally displace the slab (24) by means of a controlled lateral displacement of a trolley (34) supporting said transport rollers (39) and constituting at least part of said heating and temperature maintenance furnace (15), said lateral displacement being governed by said means (36) to control the axial position of the slab (24).

4. Method as in claim 1, characterised in that said alignment means operating inside the heating and temperature maintenance furnace (15) laterally displace the slab (24) by means of a controlled lateral displacement, either individually or in groups, of said transport rollers (39) inside said heating and temperature maintenance furnace (15), said displacement being governed by said means (36) to control the axial position of the slab (24).

5. Method as in claim 1, characterised in that said alignment means operating inside said heating and temperature maintenance furnace (15) laterally displace the slab (24) by means of an independent control, either individually or in groups, of the speed of rotation of said transport rollers (39) inside said heating and temperature maintenance furnace (15), said transport rollers (39) being inclined with respect to said supporting and conveying plane on which said slab (24) lies, the independent control being governed by said means (36) to control the axial position of the slab (24).

6. Method as in claim 1, characterised in that said alignment means operating inside the heating and temperature maintenance furnace (15) laterally displace the slab (24) by means of the controlled lifting of one side of said transport rollers (39) placed inside said heating and temperature maintenance furnace (15), said controlled lifting being governed by said means (36) to control the axial position of the slab (24).

7. Method as in claim 1, characterised in that said alignment means operating inside the heating and temperature maintenance furnace (15) laterally displace the slab (24) by means of the controlled insertion inside said furnace (15), on one side or the other, of at least a conical roller (51) with a working plane inclined in the direction of said furnace (15) and arranged in the space between said transport rollers (39), the controlled insertion being governed by said means (36) to control the axial position of the slab (24).

8. Method as in claim 7, characterised in that said conical rollers (51) are maintained constantly inside the furnace (15), at the side of the slab (24) on one side and the other, with the function of controlling the position and limiting the maximum lateral displacement of said slab (24).

9. Method as in claim 1, in which said trasport rollers (39) cooperate with a plurality of disks (40) arranged coaxially on at least part of their periphery, characterised in that said alignment means operating inside said heating and temperature maintenance furnace (15) laterally displace the slab (24) by means of arranging said disks (40) in alternation on one half of one roller (39) and on the other half of the subsequent roller (39), and by independently controlling the speed of rotation of said rollers (39).

10. Method as in claim 1, characterised in that provides to continuously control the axial position of the slab (24) at least upstream of the entrance of said first rolling stand and to act in feedback on systems of differentiated cooling (28) arranged downstream said ingot mold (13) and in the proximity of the two sides of the slab (24), said systems being able to create on said sides of the slab (24) a differentiated thermal expansion.

11. Method as in claim 10, characterised in that, if said thermal expansion causes too great an axial displacement which cannot be compensated downstream, it provides to sheare said slab (24) by said shearing means (14), as an emergency function, so as to obtain short slabs.

12. Device to control the axial position of slabs emerging from continuous casting applied in rolling lines comprising at least a continuous casting machine (11) with at least one ingot mold (13), an extraction and straightening assembly (12), shearing means (14), a heating and/or temperature maintenance furnace (15) comprising a plurality of transport rollers (39) arranged parallel to each other with their axis substantially orthogonal to the axis of feed of the slab (24) and defining a substantially horizontal supporting and conveying plane for said slab, a roughing or pre-finishing train (16) and a finishing train (19) defining a rolling axis (25), there being included between the outlet of said heating and/or temperature maintenance furnace (15) and the inlet of the roughing or pre-finishing train (16) lateral guides (20) and at least a descaling assembly (22), the device being characterised in that it comprises means (36) to control the axial position of said slab (24) with respect to said rolling axis (25), said means (36) being arranged at least upstream of a first stand of said roughing or pre-finishing train (16) or of said finishing train (19), and alignment means operating inside said heating and/or temperature maintenance furnace (15) and cooperating with said transport rollers (39), said alignment means being able to induce a controlled lateral displacement of said slab (24) in transit on said supporting and conveying plane functionally correlated to the control of said axial position made by said means (36).

13. Device as in claim 12, characterised in that said alignment means comprise means (57) to regulate the inclination of at least some of said transport rollers (39) on the horizontal plane on which the rollers (39) lie, said regulation means (57) being governed by a control unit (30) which receives signals from said means (36) which control the position of the axis (32) of said slab (24).

14. Device as in claim 13, characterised in that comprises at least one regulation means (57*a*) in cooperation with one side of said transport rollers (39) and one regulation means (57*b*) in cooperation with the opposite side of said transport rollers (39).

15. Device as in claim 13, characterised in that said transport rollers (39) are connected together in groups, each group cooperating with a relative means (57) to regulate their inclination.

16. Device as in claim 12, characterised in that said alignment means comprise means for the controlled lateral displacement (33) of a trolley (34) supporting said transport rollers (39) inside said heating and/or temperature maintenance furnace (15).

17. Device as in claim 12, characterised in that said alignment means comprise means for the controlled lateral displacement (41) of said transport rollers (39), individually or in groups, of said heating and/or temperature maintenance furnace (15).

18. Device as in claim 12, characterised in that said alignment means comprise means of differentiated control, individually or in groups, of the speed of rotation of said rollers (39) inside said heating and/or temperature maintenance furnace (15).

19. Device as in claim 18, characterised in that said rollers (39) of said heating and/or temperature maintenance furnace (15) are inclined with respect to said supporting and conveying plane and are divided between odd rollers (39*a*) and even rollers (39*b*), said odd rollers (39*a*) and said even rollers (39*b*) including respective autonomous drive mechanisms governed by respective control means connected with said means (36) to control the axial position of the slab (24).

20. Device as in claim 12, characterised in that said alignment means comprise actuator means (50) for the controlled lifting of one side of said transport rollers (39).

21. Device as in claim 20, characterised in that said transport rollers (39) are associated on the motor side with a stationary support (48) and on the opposite side with a support (49) movable at least vertically.

22. Device as in claim 21, characterised in that said movable support (49) consists of a plane inclined towards the furnace (15) associated with an actuator (50) of horizontal displacement.

23. Device as in claim 12, characterised in that said alignment means comprise controlled displacement means (53) to take a plurality of rollers (51), with a conical work plane and an axis substantially parallel to the axis (37) of said transport rollers (39), from a stand-by position at the side of and outside said furnace (15) to a position inside said furnace (15) and in contact with said slab (24).

24. Device as in claim 23, characterised in that said conical rollers (51) are mounted as cantilevers on relative supports (52) associated with a slider (53), said slider (53) including a first position wherein the relative conical roller (51) is in a stand-by position at the side of and outside said furnace (15) and a plurality of positions wherein the relative conical roller (51) is in a position gradually further and further inside said furnace (15).

25. Device as in claim 24, characterised in that each of said conical rollers (51) includes a raised edge (55), substantially on its base.

26. Device as in claim 23, characterised in that said conical rollers (51) are arranged off-set on one side of said furnace (15) and the other in an intermediate position between said transport rollers (39).

27. Device as in claim 23, characterised in that said conical rollers (51) are arranged in pairs of coaxial rollers on one side of said furnace (15) and the other in an intermediate position between said transport rollers (39).

28. Device as in claim 23, characterised in that said conical rollers (51) include a working position constantly inside the furnace (15) with the respective raised edges (55) arranged at the sides at a desired distance from the nominal position of the edges of said slab (24) with the function of limiting the displacement thereof.

29. Device as in claim 12, characterised in that said alignment means comprise transport rollers (39) including alternately relative disks (40) half of which are grouped on one of said rollers (39) and the other half on the subsequent of said rollers (39).

30. Device as in claim 12, characterised in that comprises systems of differentiated heating (28) arranged downstream of said ingot mold (13) and cooperating with the proximity of the sides of said slab (24), said systems being able to create on said sides of the slab (24) a differentiated thermal expansion functionally correlated to to the control of the position of the axis (32) of said slab (24) on respect of said rolling axis (25).

31. Device as in claim 12, characterised in that comprises detector means (31) located downstream of said ingot mold (13) and detector means (36) arranged inside the heating and/or temperature maintenance furnace (15) or at the outlet thereof.

* * * * *